US005810964A

United States Patent [19]

Shiraishi

[11] Patent Number: 5,810,964

[45] Date of Patent: Sep. 22, 1998

[54] CHEMICAL MECHANICAL POLISHING DEVICE FOR A SEMICONDUCTOR WAFER

[75] Inventor: Yasushi Shiraishi, Tokyo, Japan

[73] Assignee: NEC Corporation, Tokyo, Japan

[21] Appl. No.: 760,218

[22] Filed: Dec. 4, 1996

[30] Foreign Application Priority Data

Dec. 6, 1995 [JP] Japan ..... 7-317884

[51] Int. Cl.[6] ..... B24B 29/00; C23F 1/04

[52] U.S. Cl. ..... 156/345; 451/286; 451/287; 451/288; 451/921

[58] Field of Search ..... 156/345; 438/691, 438/692, 693, 959; 451/286, 287, 288, 420, 548, 921

[56] References Cited

U.S. PATENT DOCUMENTS 5,468,682 11/1995 Homma ..... 437/195

5,593,344 1/1997 Weldon et al. ..... 451/296

5,643,044 7/1997 Lund ..... 451/5

*Primary Examiner*—Marian C. Knode

*Assistant Examiner*—Mary K. Zeman

*Attorney, Agent, or Firm*—Sughrue, Mion, Zinn, Macpeak & Seas, PLLC

[57] ABSTRACT

In a chemical mechanical polishing (CMP) device, a semiconductor wafer is held by a carrier with its surface to be polished facing upward. A polishing belt is fed from one reel and taken up by the other reel by way of pulleys, running in contact with the surface of the wafer to be polished. A conditioning pad conditions the front or polishing surface of the belt facing the wafer. A nozzle feeds polishing slurry to the rear of the belt not facing the wafer. A plurality of press rollers cause the slurry to exude from the front of the belt while pressing the slurry and belt against the surface of the wafer. The belt filters out impurities introduced into the slurry.

5 Claims, 3 Drawing Sheets

CHEMICAL MECHANICAL POLISHING DEVICE FOR A SEMICONDUCTOR WAFER

BACKGROUND OF THE INVENTION

The present invention relates to a chemical mechanical polishing (CMP) device for polishing the surface of a semiconductor wafer.

It has been customary with a CMP device for the above application to feed polishing slurry from a nozzle to the front or polishing surface of a polishing belt. The polishing belt polishes the surface of a wafer with the slurry while running in pressing contact with the wafer. A problem with the conventional CMP device is that impurities are apt to fall onto the front of the belt and get mixed with the slurry fed to the front of the belt. The impurities are likely to form microscratches on the surface of the wafer to be polished. Another problem is that the slurry fed to the front of the belt cannot reach the intermediate portion of the wafer contacting the belt. This prevents the belt from polishing the entire surface of the wafer to a uniform thickness.

SUMMARY OF THE INVENTION

It is therefore an object of the present invention to provide a CMP device capable of obviating microscratches ascribable to impurities.

It is another object of the present invention to provide a CMP device capable of polishing the surface of a semiconductor wafer to a uniform thickness.

It is a further object of the present invention to provide a CMP device with improved yield and reliability.

A CMP device for polishing a semiconductor wafer of the present invention includes a carrier for holding the semiconductor wafer. A pad polishes the wafer while retaining polishing slurry, and allows the slurry to penetrate from the rear to the front of the pad. The carrier and pad are positioned such that the surface of the semiconductor wafer to be polished faces upward. The slurry is fed to the rear of the pad.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
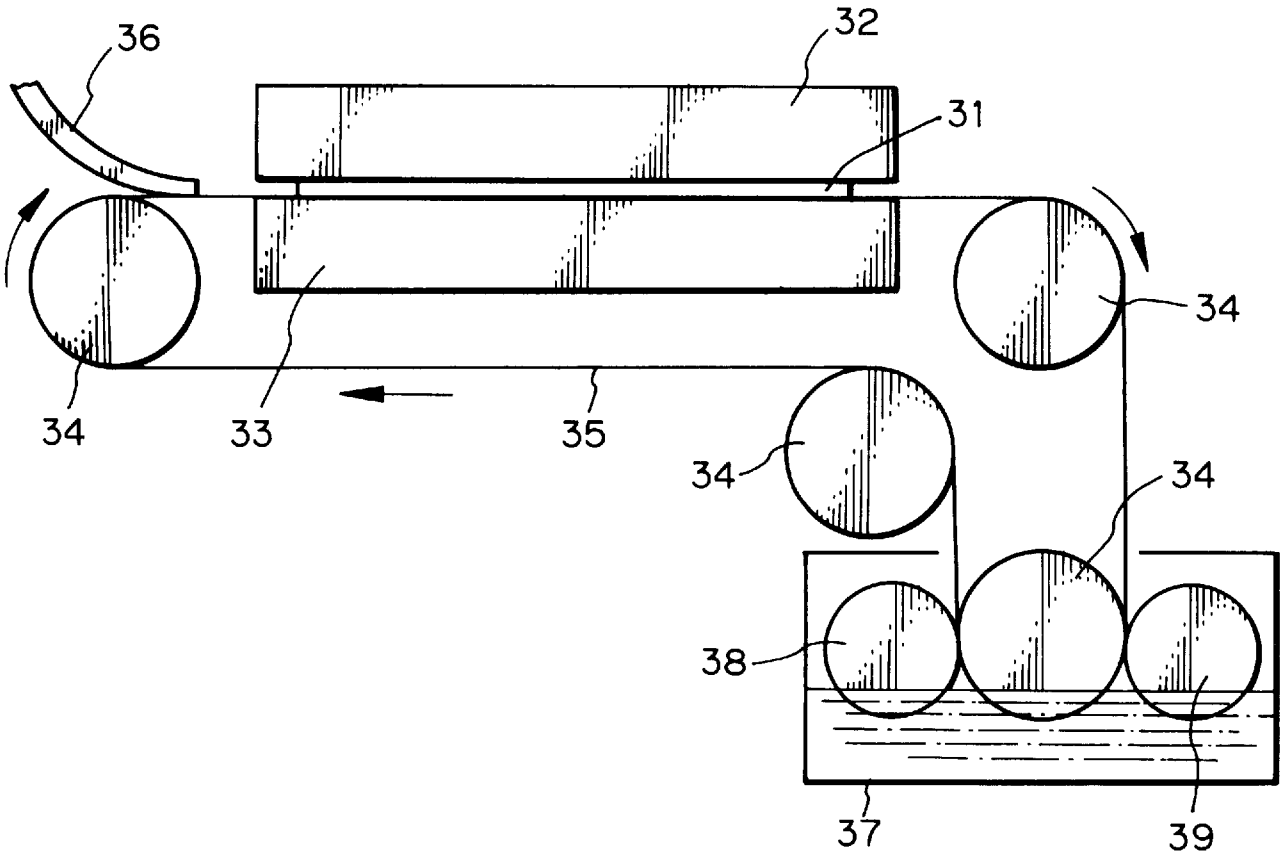
Fig. 1 PRIOR ART
FIG. 1 shows a conventional CMP device.

To better understand the present invention, a brief reference will be made to a conventional chemical mechanical polishing (CMP) device for a semiconductor wafer, shown in FIG. 1. As shown, the CMP device includes a carrier 32 for carrying a semiconductor wafer 31. A pressure table 33 is positioned beneath and spaced a predetermined distance from the carrier 32. An endless polishing belt 35 is passed over a plurality of pulleys 34 via the gap between the carrier 32 and the pressure table 33. A nozzle 36 is so positioned as to feed polishing slurry to the front or polishing surface of the polishing belt 35. A reservoir 37 stores a liquid for cleaning the polishing belt 35. A scrubber roll 38 for cleaning the belt 35 and a regenerator roll 39 for generating the belt 35 are disposed in the reservoir 37.

In operation, the wafer 31 is held by the carrier 32 face down, i.e., with its surface to be polished facing downward. While the polishing belt 35 runs via the gap between the carrier 32 and the pressure table 33, the polishing slurry is fed to the front of the belt 35 from the nozzle 36. At the same time, water or similar fluid under pressure is ejected upward from the pressure table 33. The fluid under pressure forms a film between the table 33 and the belt 35 and raises the belt 35. As a result, the belt 35 is strongly pressed against the surface of the wafer 31. The belt 35 moves in pressing contact with the surface of the wafer 31 while retaining the polishing slurry thereon. The carrier 32 may be moved back and forth in the direction perpendicular to the direction o f movement of the belt 35 in order to polish the wafer 31 more effectively. The belt 35 contaminated and deteriorated due to its polishing operation is regenerated by the scrubber roll 38 and regenerator roll 39.

A problem with the above CMP device is that impurities are apt to fall onto the front of the belt 35 and get mixed with the slurry fed from the nozzle 36 onto the belt 35. The impurities are likely to form microscratches on the surface of the wafer 31 to be polished. Another problem is that the slurry fed to the front of the belt 35 collides against the edge of the wafer 31 and cannot reach the intermediate portion of the wafer 31 contacting the belt 35. This prevents the belt 35 from polishing the entire surface of the wafer 31 to a uniform thickness.

Figure 2:
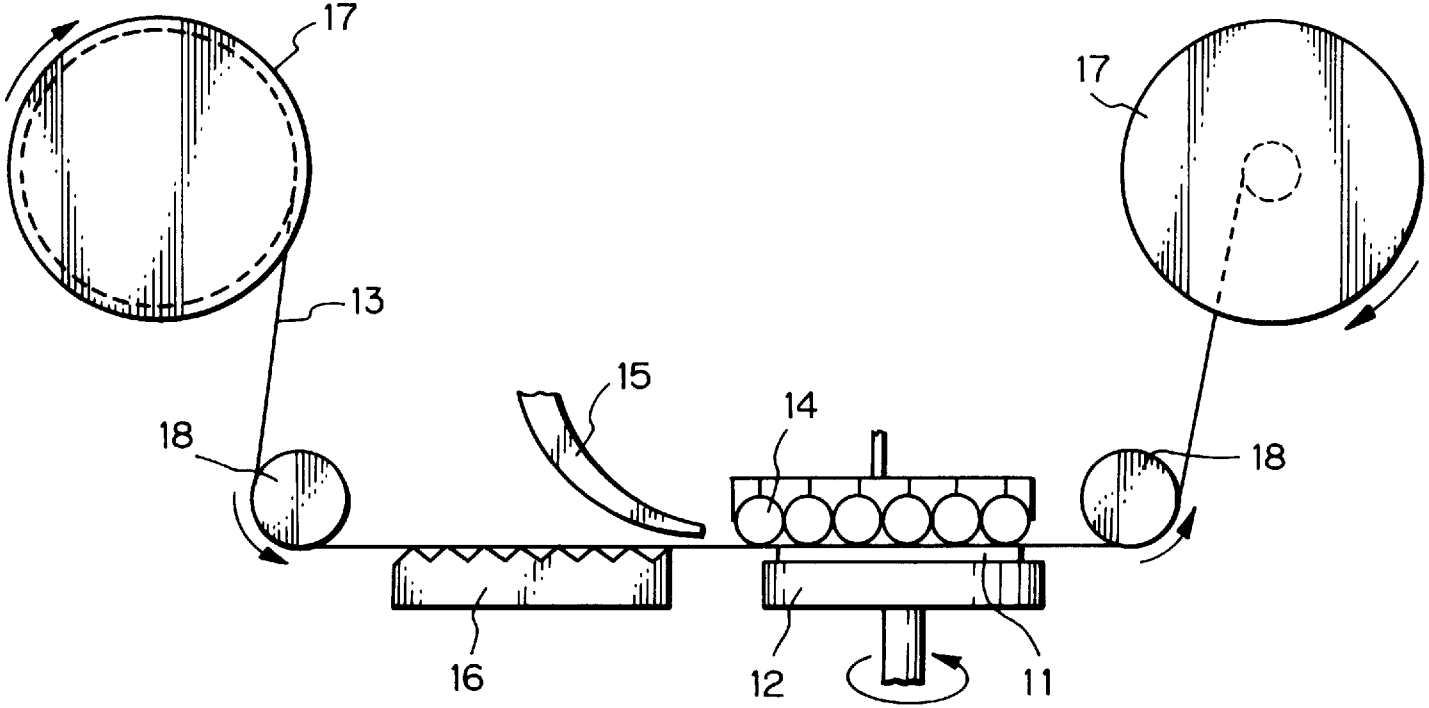
FIG. 2 shows CMP device embodying the present invention.

Referring to FIG. 2, a CMP device embodying the present invention will be described. As shown, the CMP device includes a carrier 12 for carrying a wafer 11. A polishing belt 13 polishes the surface of the wafer 11 held by the carrier 12. A plurality of press rollers 14 allow the wafer 11 to be polished uniformly. A nozzle 15 feeds polishing slurry to the rear of the belt 13 which does not face the wafer 11. A conditioning pad 16 conditions the front of the belt 13 which faces the wafer 11. The belt 13 is fed from one of a pair of reels 17 and taken up by the other reel 17 by way of pulleys 18.

Figure 3A:
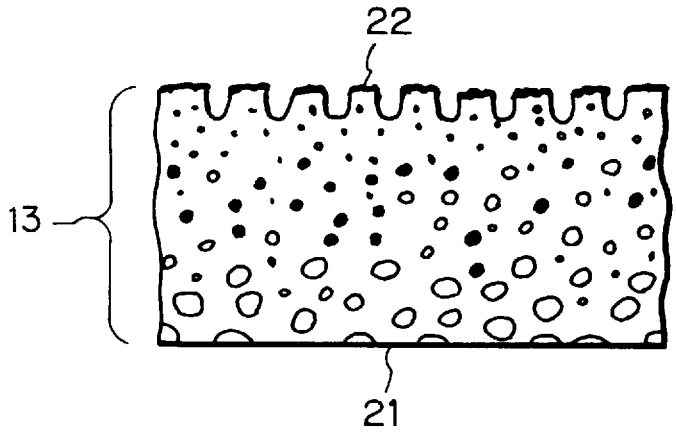
FIGS. 3A AND 3B are sections each showing a particular configuration of a polishing belt included in the embodiment.
Figure 3B:
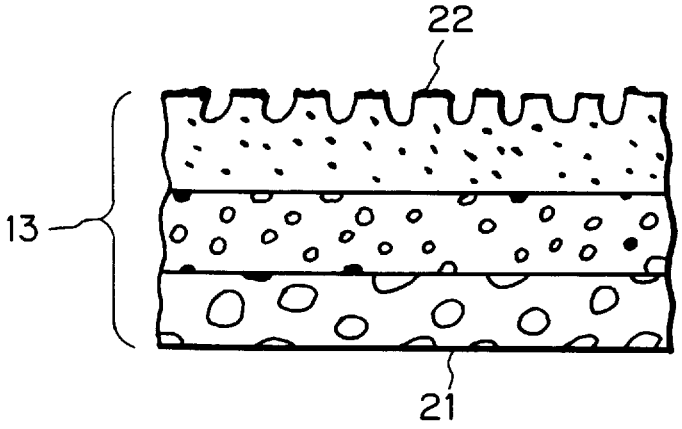

As shown in FIG. 3A, the belt 13 may be implemented by a single layer of foam material, e.g., polyurethane. Cells formed in the foam material 13 sequentially decrease in diameter from the rear 21 to the front or polishing surface 22 of the material 13. Alternatively, as shown in FIG. 3B, the belt 13 may be implemented as a laminate of layers of urethane or similar foam material each having a particular cell diameter. In this case, each layer of the laminate may be provided with a particular hardness. In any case, the foam material constituting the belt 13 has a cell diameter ranging from about 2 $\mu$m to about 0.5 $\mu$m.

In operation, the wafer 11 is held on the upper surface of the carrier 12 with its surface to be polished facing upward. Then, the carrier 12 is moved to press the wafer 11 against the front of the belt 13. The belt 13 is fed from one reel 17 and taken up by the other reel 17 by way of the surface of the wafer 11. At this instant, the conditioning pad 16 provides the front of the belt 13 with an adequate polishing condition. The polishing slurry is fed from the nozzle 15 to the rear of the belt 13 at a position ahead of of the press rollers 14.

The slurry fed to the belt 13 soaks into the belt 13 toward the front due to gravity, and then exudes from the front due to the pressure of the press rollers 14. Because impurities dropped onto the rear of the belt 13 or introduced into the slurry cannot pass through the belt 13, only the slurry free from impurities reaches the front of the belt 13. The slurry reached the front of the belt 13 is pressed against the surface of the wafer 11 together with the belt 13 by the belt 13. The belt 13 therefore runs continuously while pressing the slurry against the entire surface of the wafer 11. As a result, the surface of the wafer 11 is polished in a desirable manner.

If desired, the pressure of the individual press roller 14 may be monitored in order to adjust it independently of the others so as to promote uniform polishing. In addition, the carrier 12 may be rotated about its own axis, as indicated by an arrow in FIG. 2, so as to further promote uniform polishing. Of course, the above control over the pressure of the press rollers 14 and the rotation of the carrier 12 may be combined.

As stated above, in the illustrative embodiment, the cells of the belt 13 sequentially decrease in diameter from the rear to the front or polishing surface of the belt 13. This allows the slurry fed to the rear of the belt 13 to soak into the belt 13 rapidly. The slurry soaked into the belt 13 is pressed by the press rollers 14 and forced out from the front of the belt 13 thereby. At this instant, the belt 13 plays the role of a filter for filtering out impurities and frees the wafer 11 from microscratches ascribable to the impurities. Because the slurry soaks into the belt 13 rapidly, it exudes from the front of the belt 13 in a sufficient amount for polishing. Consequently, the slurry is fed to the entire surface of the wafer 11 in a uniform distribution, polishing the wafer 11 to a uniform thickness.

In summary, it will be seen that the present invention provides a CMP device which feeds slurry to the rear of a polishing belt and thereby removes impurities from the slurry due to a filtering effect available with the belt. The device therefore allows a minimum of microscratches to appear on the polished surface of a semiconductor wafer. Further, because the belt is formed of a foam material having cells whose diameter changes stepwise, the slurry is fed to the entire surface of the wafer uniformly by press rollers, and in addition provided with a uniform grain size. This allows the wafer to be polished to a uniform thickness. Moreover, the device enhances the yield and reliability of products and thereby improves the characteristic of devices.

Various modifications will become possible for those skilled in the art after receiving the teachings of the present disclosure without departing from the scope thereof.

What is claimed is:

1. A chemical mechanical polishing (CMP) device for polishing a work surface of a semiconductor wafer, comprising:

a carrier for holding the semiconductor wafer such that the work surface faces upwards;

a porous pad having a polishing side facing downwards for contacting the work surface of the semiconductor wafer and a rear side facing upwards for receiving a polishing slurry thereon;

support means for mounting the carrier and the porous pad for relative movement therebetween; and a means for providing a polishing slurry onto the rear side of the porous pad;

wherein, upon providing a polishing slurry onto the rear side of the porous pad, the force of gravity influences the polishing slurry to permeate through the porous pad, from the rear side to the polishing side, whereby impurities are filtered from the polishing slurry.

2. A CMP device as claimed in claim 1, further comprising a plurality of press rollers positioned opposite the carrier such that the porous pad is interposed therebetween, said plurality of press rollers for pressing the porous pad against the semiconductor wafer and for causing the permeated polishing slurry to exude from the polishing surface of the porous pad.

3. A CMP device as claimed in claim 2, further comprising means for adjusting a pressure of an individual press roller.

4. A CMP device as claimed in claim 1, wherein the porous pad has pores with diameters that sequentially decrease from the rear side to the polishing side.

5. A CMP device as claimed in claim 1, wherein said porous pad comprises an elongate polishing belt.

* * * * *